United States Patent [19]

Skaggs

[11] 4,157,156

[45] Jun. 5, 1979

[54] PARTITION ARRANGEMENT

[75] Inventor: Boyd T. Skaggs, Louisville, Ky.

[73] Assignee: Container Corporation of America, Chicago, Ill.

[21] Appl. No.: 876,523

[22] Filed: Feb. 10, 1978

[51] Int. Cl.[2] ..... B65D 5/48; B65D 25/04

[52] U.S. Cl. ..... 229/15; 229/42

[58] Field of Search ..... 229/15, 42, 28

[56] References Cited

U.S. PATENT DOCUMENTS

| | | | |
|---|---|---|---|
| 1,860,567 | 5/1932 | Boeye | 229/15 |
| 2,517,767 | 8/1950 | Cody | 229/15 X |
| 2,830,749 | 4/1958 | Lauritzen | 229/15 |
| 3,301,460 | 1/1967 | Harrison | 229/15 |
| 3,738,561 | 6/1973 | Neoerveld | 229/15 |
| 3,931,924 | 1/1976 | Gardner | 229/15 |
| 3,963,169 | 6/1976 | Gardner | 229/28 |
| 4,077,561 | 3/1978 | Gardner | 229/42 |

*Primary Examiner*—Davis T. Moorhead

*Attorney, Agent, or Firm*—Carpenter & Ostis

[57] ABSTRACT

An internal partition device formed of a rectangular unitary blank of paperboard for providing six cells within an outer package or container.

2 Claims, 3 Drawing Figures

PARTITION ARRANGEMENT

SUMMARY OF THE INVENTION

It is an object of the invention to provide a one piece paperboard partition or divider for forming six cells within an outer package such as a paperboard shipping container.

It is another object of the invention to provide an internal partition which may be formed from a rectangular blank of paperboard to insure a minimum amount of waste in production.

A more specific object of the invention is to provide a six cell forming partition including a pair of transverse members interconnected by a bottom member, and a longitudinal member having a center section interposed between the transverse members and end sections disposed outboardly of the transverse members.

These and other objects of the invention will be apparent from an examination of the following description and drawings.

THE DRAWINGS

It will be understood that, for purposes of clarity, certain elements may have been intentionally omitted from certain views where they are believed to be illustrated to better advantage in other views.

THE DESCRIPTION

Figure 1:
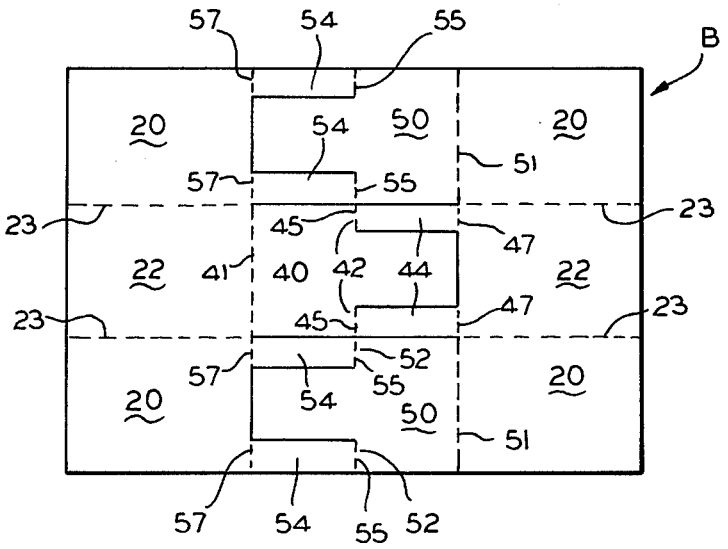
FIG. 1 is a plan view of a blank of foldable sheet material from which the partition illustrated in the other views may be formed.
Figure 2:
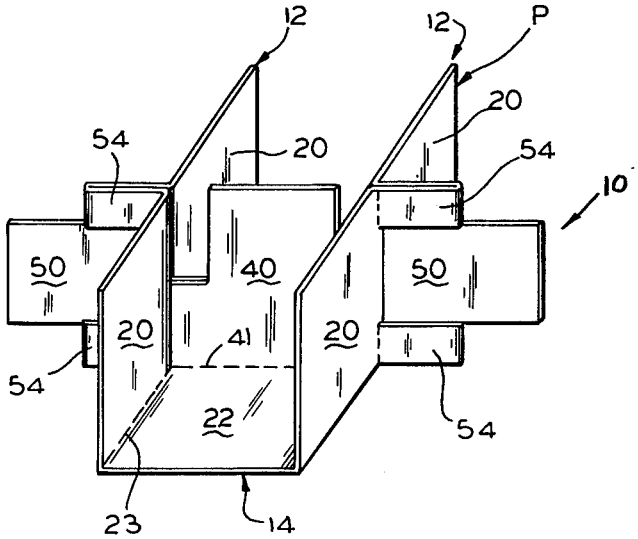
FIG. 2 is a perspective view of a partition structure embodying features of the invention, as shown in the fully erected condition.
Figure 3:
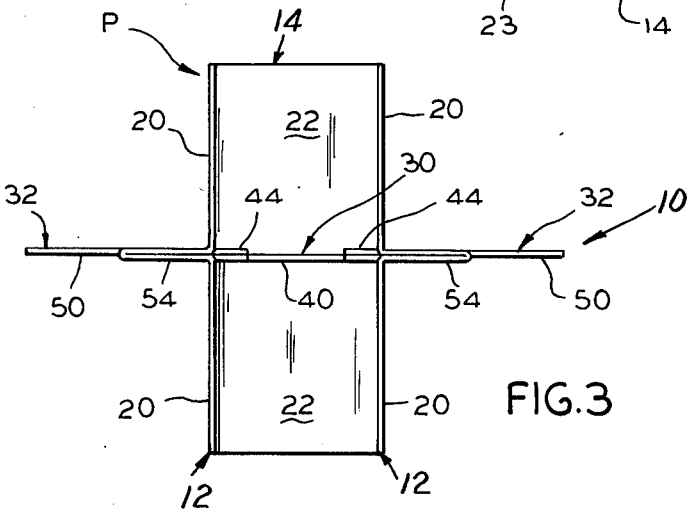
FIG. 3 is a plan view of the structure illustrated in FIG. 2.

Referring now to the drawings for a better understanding of the invention, it will be seen that a partition, indicated generally at P and illustrated in FIGS. 2 and 3, may be formed from a unitary blank B of foldable sheet material, such as paperboard, as illustrated in FIG. 1.

As best seen in FIG. 2, partition P includes a vertically disposed longitudinal member 10 and a pair of vertically disposed transverse members 12 spaced from each other in parallel relationship and interconnected by a bottom member 14.

Each of the transverse members 12 includes a pair of panels 20 which are aligned with each other in end to end relation. Bottom member 14 also inludes a pair of panels 22 aligned with each other in end to end relation, with each panel 22 being foldably joined at its opposite side edges along fold lines 23 with the adjacent lower edges of the related panels 20 of the transverse members. Still referring to FIG. 2, it will be seen that longitudinal member 10 includes a center section, generally designated 30, and a pair of end sections, generally designated 32, which are aligned with each other in end to end relation, with the center section being interposed between transverse members 12 and with the end sections being disposed outboardly of the respective transverse members Longitudinal member center section 30 includes a major panel 40 foldably joined along its lower edge along fold line 41 to an inboard edge of an adjacent bottom panel 22.

It will be noted that panel 40 is generally in the shape of an inverted T with opposed upper corners cut away to provide a pair of shoulders 42. Center section 40 also includes a minor panel which preferably includes a pair of longitudinally spaced relatively narrow panel portions 44 which are foldably joined at their upper edges on fold lines 45 to shoulders 42 of panel 40 and which are foldably joined at their lower edges along fold lines 47 to inboard edges of the other bottom panel 22.

Each of the end sections 32 of the longitudinal member 10 is formed with a construction similar to that of longitudinal member center section 30. Each end section 32 includes a generally T shaped major panel 50 which is foldably joined at its inboard edge along fold line 51 in an inboard edge of a related transverse member panel 20. Each end section also includes a minor panel having a pair of relatively narrow panel portions 54 which are foldably joined at their outboard edges along fold lines 55 to opposed shoulders 52 of panel 50 and which are foldably joined at their inboard edges along fold lines 57 to adjacent edges of a related transverse member panel 20.

Thus it will be understood that the invention provides a partition formed from a rectangular blank so as to utilize the absolute minimum amount of material and which can be easily erected or knocked down for shipping purposes.

I claim:

1. A partition, formed of a unitary blank of foldable paperboard, for forming six cells within an outer package, comprising:

(a) a pair of vertically disposed transverse members spaced from each other in parallel relation and having lower edges foldably joined to each other by a bottom member;

(b) said bottom member and said transverse members each including a pair of panels aligned with each other in end-to-end relation;

(c) a vertically disposed longitudinal member including a center section located intermediate said transverse members and a pair of end sections located outboardly of respective transverse members;

(d) said center section including a pair of panels foldably joined to each other and to inboard edges of respective bottom member panels;

(e) each of said end sections including a pair of panels foldably joined to each other and to inboard edges of respective panels of a related transverse member.

2. A partition according to claim 1, wherein each section of said longitudinal member includes:

(a) a generally T-shaped major panel having outer corners recessed to provide shoulders;

(b) a minor panel including a pair of relatively narrow panel portions spaced from each other and foldably to said major panel at the shoulders thereof.

* * * * *